US011384995B2

(12) United States Patent
Minami et al.

(10) Patent No.: US 11,384,995 B2
(45) Date of Patent: Jul. 12, 2022

(54) FINLESS HEAT EXCHANGER AND REFRIGERATION CYCLE APPARATUS

(71) Applicant: Mitsubishi Electric Corporation, Chiyoda-ku (JP)

(72) Inventors: Shinichiro Minami, Chiyoda-ku (JP); Takashi Matsumoto, Chiyoda-ku (JP); Shigeyoshi Matsui, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 126 days.

(21) Appl. No.: 16/652,510

(22) PCT Filed: Dec. 11, 2017

(86) PCT No.: PCT/JP2017/044264
§ 371 (c)(1),
(2) Date: Mar. 31, 2020

(87) PCT Pub. No.: WO2019/116413
PCT Pub. Date: Jun. 20, 2019

(65) Prior Publication Data
US 2020/0256625 A1 Aug. 13, 2020

(51) Int. Cl.
*F28F 1/32* (2006.01)
*F28D 1/047* (2006.01)
(Continued)

(52) U.S. Cl.
CPC ..... *F28F 1/32* (2013.01); *F28D 1/0477* (2013.01); *F25B 39/00* (2013.01);
(Continued)

(58) Field of Classification Search
CPC ..... F28D 1/0477; F28D 2001/0273; F28D 2021/0068; F28F 1/32; F28F 9/00;
(Continued)

(56) References Cited

U.S. PATENT DOCUMENTS 6,488,080 B1 * 12/2002 Lee ..... F28F 9/0204 165/150
2007/0114005 A1 * 5/2007 Bronold ..... H01M 8/04059 165/59
(Continued)

FOREIGN PATENT DOCUMENTS

JP H09-292196 A 11/1997
JP H09292196 A * 11/1997
(Continued)

OTHER PUBLICATIONS

International Search Report dated Feb. 13, 2018 in PCT/JP2017/044264 filed Dec. 11, 2017, 2 pages.
(Continued)

*Primary Examiner* — Harry E Arant
(74) *Attorney, Agent, or Firm* — Xsensus LLP

(57) ABSTRACT

A finless heat exchanger includes two headers and a plurality of heat transfer tubes spaced apart from each other and arranged side by side. The two headers each have a plurality of insertion holes, to which both ends of the heat transfer tubes are fitted and connected. The heat transfer tubes each include straight portions extending in a direction orthogonal to an arrangement direction, in which the heat transfer tubes are arranged, and turning portions. The straight portions and the turning portions are alternately and continuously arranged.

18 Claims, 15 Drawing Sheets

(51) Int. Cl.

| | |
|---|---|
| *F25B 39/00* | (2006.01) |
| *F28D 1/02* | (2006.01) |
| *F28D 21/00* | (2006.01) |

(52) U.S. Cl.
CPC ..... *F28D 2001/0273* (2013.01); *F28D 2021/0068* (2013.01); *F28F 2215/12* (2013.01)

(58) Field of Classification Search
CPC ..... F28F 9/0246; F28F 9/0273; F28F 9/013; F28F 9/0136; F28F 2215/12; F25B 39/00
See application file for complete search history.

(56) References Cited

U.S. PATENT DOCUMENTS

| | | | | |
|---|---|---|---|---|
| 2011/0100593 | A1 | 5/2011 | Benz et al. | |
| 2014/0027101 | A1 | 1/2014 | Konkle et al. | |
| 2019/0129479 | A1 * | 5/2019 | Zhou | H05K 7/20272 |

FOREIGN PATENT DOCUMENTS

| | | | | | |
|---|---|---|---|---|---|
| JP | 2005-127596 | A | | 5/2005 | |
| JP | 2006-317080 | A | | 11/2006 | |
| JP | 2006317080 | A | * | 11/2006 | F28D 1/0478 |
| JP | 2009-145010 | A | | 7/2009 | |
| JP | 2010-203726 | A | | 9/2010 | |
| JP | 2010-276298 | A | | 12/2010 | |
| JP | 2015-90237 | A | | 5/2015 | |
| JP | 2015090237 | A | * | 5/2015 | |
| JP | 2017-49003 | A | | 3/2017 | |

OTHER PUBLICATIONS

Extended European Search Report dated Nov. 19, 2020 in European Patent Application No. 17935032.7, 7 pages.
Chinese Office Action dated Mar. 30, 2021 issued in corresponding Chinese patent application No. 201780097093.6.
Chinese Office Action dated Oct. 12, 2021 issued in corresponding Chinese patent application No. 201780097093.6.

* cited by examiner

Comparative Example

FIG. 11 Comparative Example
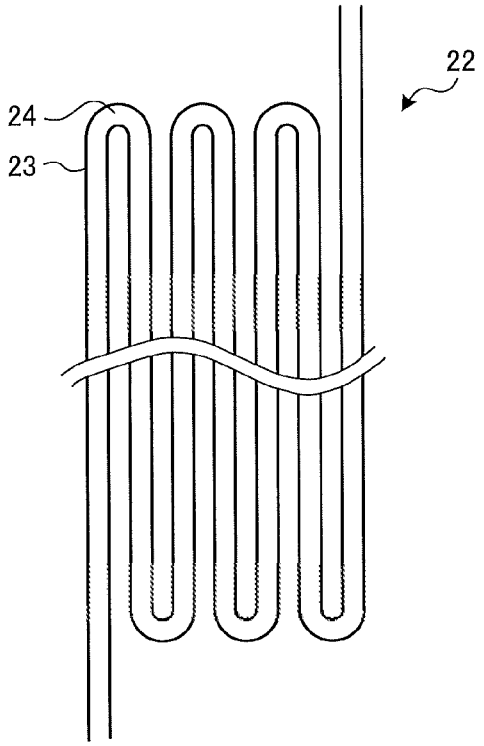
FIG. 12
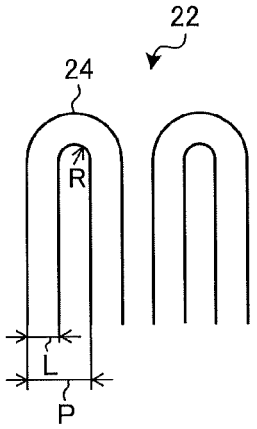

FINLESS HEAT EXCHANGER AND REFRIGERATION CYCLE APPARATUS

TECHNICAL FIELD

The present disclosure relates to a finless heat exchanger with no fins and a refrigeration cycle apparatus.

BACKGROUND ART

A finless heat exchanger, which has no fins, has been developed as a heat exchanger having heat exchange performance and compactness (refer to Patent Literature 1, for example). The finless heat exchanger disclosed in Patent Literature 1 includes two headers arranged apart from each other and a plurality of heat transfer tubes spaced apart and arranged side by side between the two headers, fitted at opposite ends in the two headers, and secured to the headers. The heat transfer tubes, which are flat tubes, are arranged parallel to each other such that the major axis of the cross-section of each flat tube extends in an air flow direction.

The finless heat exchanger disclosed in Patent Literature 1 is configured such that the flat tubes each having a short minor axis in cross-section are arranged at a narrow pitch. Such a configuration ensures the compactness and allows the heat exchanger to have higher heat exchange performance than a finned-tube heat exchanger.

CITATION LIST

Patent Literature

Patent Literature 1: Japanese Unexamined Patent Application Publication No. 2009-145010

SUMMARY OF INVENTION

Technical Problem

In the finless heat exchanger disclosed in Patent Literature 1, the two headers each have a plurality of insertion holes equal in number to the heat transfer tubes. Increasing the number of heat transfer tubes to improve the heat exchange performance increases the number of insertion holes to be formed in each header. The insertion holes can be formed using any of various processing methods. If the insertion holes are formed by cutting or stamping, strain due to poor strength of portions between the insertion holes may remain in the headers, resulting in a reduction in ease of processing of the headers. If the insertion holes are formed by wire cutting or electrical discharge machining, the cost of processing may increase.

Other problems arising from an increase in the number of heat transfer tubes include the difficulty of handling the multiple heat transfer tubes during assembly. This difficulty results in a reduction in ease of assembly.

As described above, increasing the number of heat transfer tubes to improve the heat exchange performance reduces the ease of processing of the headers and the ease of overall assembling, leading to lower productivity.

The finless heat exchanger and the refrigeration cycle apparatus of the present disclosure has been made to overcome the above-described problems and aims to provide a finless heat exchanger and a refrigeration cycle apparatus in which, while heat exchange performance is maintained, a reduction in the number of heat transfer tubes and a reduction in the number of insertion holes are achieved to improve productivity.

Solution to Problem

A finless heat exchanger according to an embodiment of the present disclosure includes two headers; and a plurality of heat transfer tubes spaced apart from each other and arranged side by side, the two headers each having a plurality of insertion holes, to which both ends of the plurality of heat transfer tubes are fitted and connected, the plurality of heat transfer tubes each including straight portions extending in a direction orthogonal to an arrangement direction in which the plurality of heat transfer tubes are arranged and turning portions, the straight portions and the turning portions being alternately and continuously arranged.

Advantageous Effects of Invention

Each heat transfer tube in the embodiment of the present disclosure includes the straight portions extending in the direction orthogonal to the arrangement direction and the turning portions, and the straight portions and the turning portions are alternately and continuously arranged. In other words, the multiple straight portions arranged side by side are connected by the turning portions, thus forming a single heat transfer tube. Such a configuration achieves a reduction in the number of heat transfer tubes and a reduction in the number of insertion holes in the headers while maintaining heat exchange performance. This results in improved productivity.

BRIEF DESCRIPTION OF DRAWINGS

FIG. 11 is a diagram illustrating a heat transfer tube included in the finless heat exchanger according to Embodiment 1 as a comparative example.

FIG. 12 is an enlarged view of turning portions of the heat transfer tube of FIG. 11.

DESCRIPTION OF EMBODIMENTS

Heat exchangers according to embodiments of the present disclosure will be described in detail below with reference to the drawings. In the figures, the same elements or equivalents are designated by the same reference signs. The following embodiments should not be construed as limiting the present disclosure. Note that the relative sizes of components illustrated in the following figures may differ from those in actual apparatuses.

Embodiment 1

Figure 1:
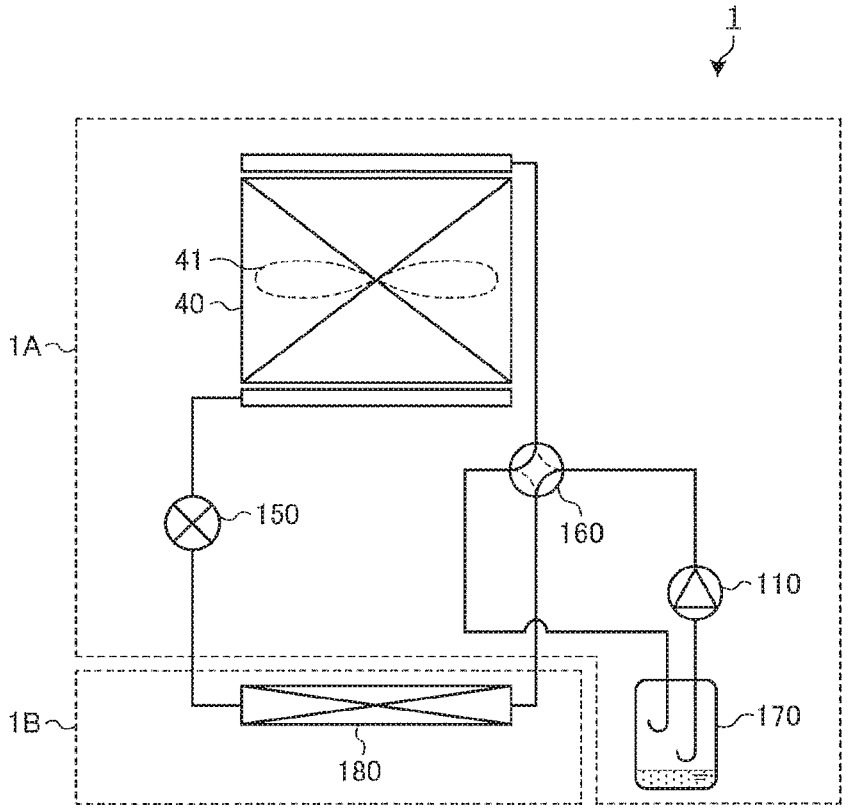
FIG. 1 is a diagram schematically illustrating the configuration of a refrigerant circuit of a refrigeration cycle apparatus according to Embodiment 1 of the present disclosure.

FIG. 1 is a diagram schematically illustrating the configuration of a refrigerant circuit of a refrigeration cycle apparatus according to Embodiment 1 of the present disclosure. An air-conditioning apparatus that conditions air in an indoor space, serving as an air-conditioned space, will be described as an example of the refrigeration cycle apparatus.

An air-conditioning apparatus 1 includes a heat source side unit 1A and a use side unit 1B. The heat source side unit 1A and the use side unit 1B constitute a refrigeration cycle through which refrigerant is circulated, and the heat source side unit 1A discharges or supplies heat for air-conditioning. The heat source side unit 1A is installed outside. The heat source side unit 1A includes a compressor 110, a flow switching device 160, a heat source side heat exchanger 40, an expansion device 150, and an accumulator 170. The heat source side unit 1A further includes a fan 41 that sends air to the heat source side heat exchanger 4, and the fan 41 faces the heat source side heat exchanger 4.

The use side unit 1B, which is installed in an indoor space, serving as an air-conditioned space, includes a use side heat exchanger 180 and a fan (not illustrated) that sends air to the use side heat exchanger 180. The air-conditioning apparatus 1 includes the refrigeration cycle including the compressor 110, the flow switching device 160, the use side heat exchanger 180, the heat source side heat exchanger 40, and the expansion device 150.

The compressor 110 compresses sucked refrigerant into a high temperature, high pressure state. The compressor 110 is configured as a scroll compressor or a reciprocating compressor.

The flow switching device 160 switches between a heating passage and a cooling passage in response to switching between an operation mode for a heating operation and an operation mode for a cooling operation. The flow switching device 160 is configured as a four-way valve. In the heating operation, the flow switching device 160 connects a discharge side of the compressor 110 and the use side heat exchanger 180 and connects the heat source side heat exchanger 40 and the accumulator 170. In the cooling operation, the flow switching device 160 connects the discharge side of the compressor 110 and the heat source side heat exchanger 40 and connects the use side heat exchanger 180 and the accumulator 170. Although FIG. 1 illustrates a case where the four-way valve is used as the flow switching device 160, the flow switching device may have any configuration. For example, a plurality of two-way valves may be combined into the flow switching device 160.

The heat source side heat exchanger 40 is configured as a finless heat exchanger. The structure of the finless heat exchanger will now be described with reference to the figures.

Figure 2:
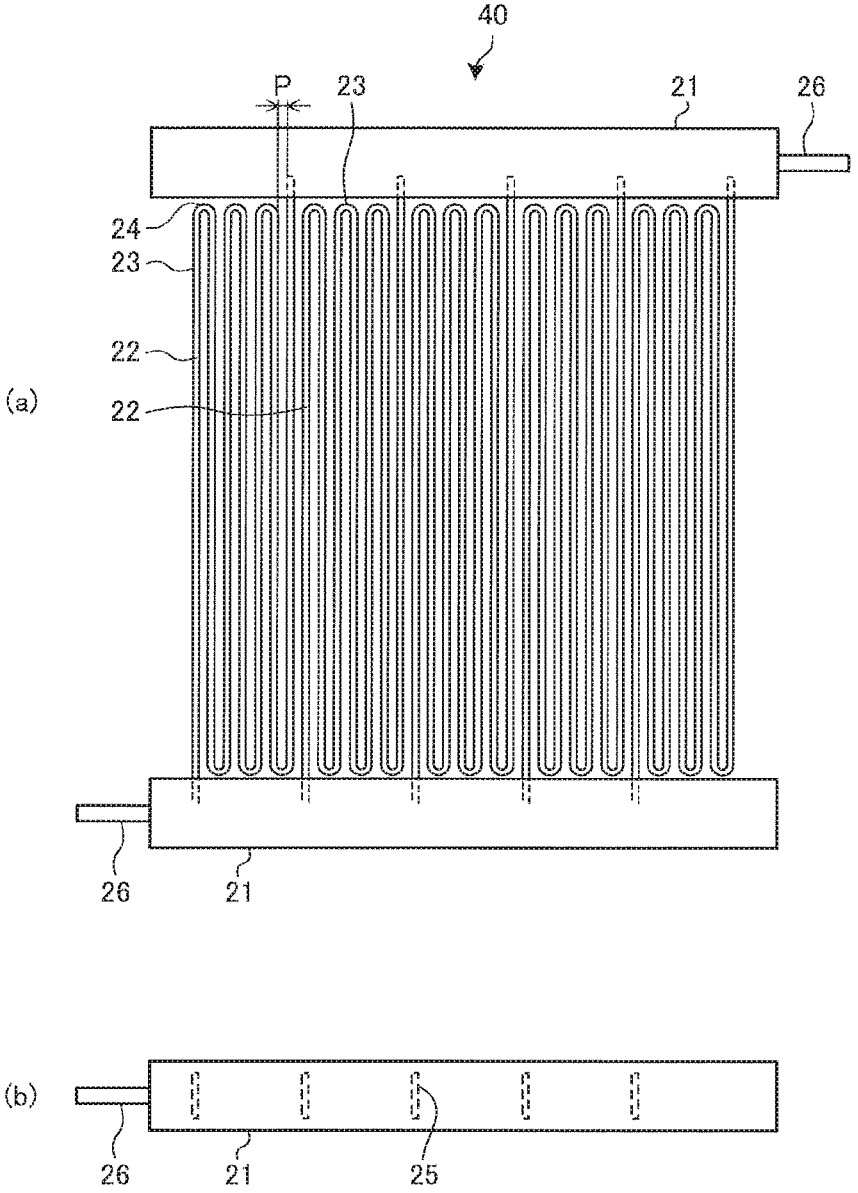
FIG. 2 includes diagrams schematically illustrating the structure of a finless heat exchanger according to Embodiment 1 of the present disclosure.

FIG. 2 includes diagrams schematically illustrating the structure of the finless heat exchanger according to Embodiment 1 of the present disclosure, (a) is a front view of the heat exchanger, and (b) is a bottom view thereof.

The finless heat exchanger according to Embodiment 1 includes two headers 21 arranged apart from each other, a plurality of heat transfer tubes 22 connected at both ends to the two headers 21, and a housing (not illustrated) containing the headers and the heat transfer tubes. The heat transfer tubes 22 are spaced apart from each other and arranged side by side. The two headers 21 are arranged apart from each other in a direction orthogonal to an arrangement direction in which the heat transfer tubes 22 are arranged side by side. The heat transfer tubes 22 are configured as flat tubes each having a flat cross-sectional shape with a major axis and a minor axis and each including a plurality of through-holes, serving as refrigerant passages. The heat transfer tubes 22 are made of aluminum-based material. The cross-sectional shape of each of the through-holes, serving as refrigerant passages, in the heat transfer tubes 22 is, for example, rectangular, square, trapezoidal, triangular, or circular.

Each heat transfer tube 22 includes straight portions 23 and turning portions 24 arranged alternately and continuously, and the straight portions 23 are substantially parallel to each other. The heat transfer tube 22 is a single-piece component formed by bending a tubular material. The heat transfer tube 22 is connected at both ends, or two positions, to the two headers 21. In FIG. 2, the air flows in a direction perpendicular to the drawing sheet of FIG. 2. The heat transfer tube 22 is placed such that the major axis in the cross-section of the heat transfer tube 22 is parallel to the air flow direction.

Each header 21 is, for example, a cylindrical pipe. The header 21 has a structure in which a first end of the cylindrical pipe is completely closed and a second end thereof except a refrigerant inlet-outlet 26 is closed. The header 21 has insertion holes 25, to which the ends of the heat transfer tubes 22 are fitted. The heat transfer tubes 22 are joined to the header 21. Portions of the heat transfer tubes 22 in contact with the insertion holes 25 of the header 21 are joined to the header 21 by brazing, for example.

Figure 3:
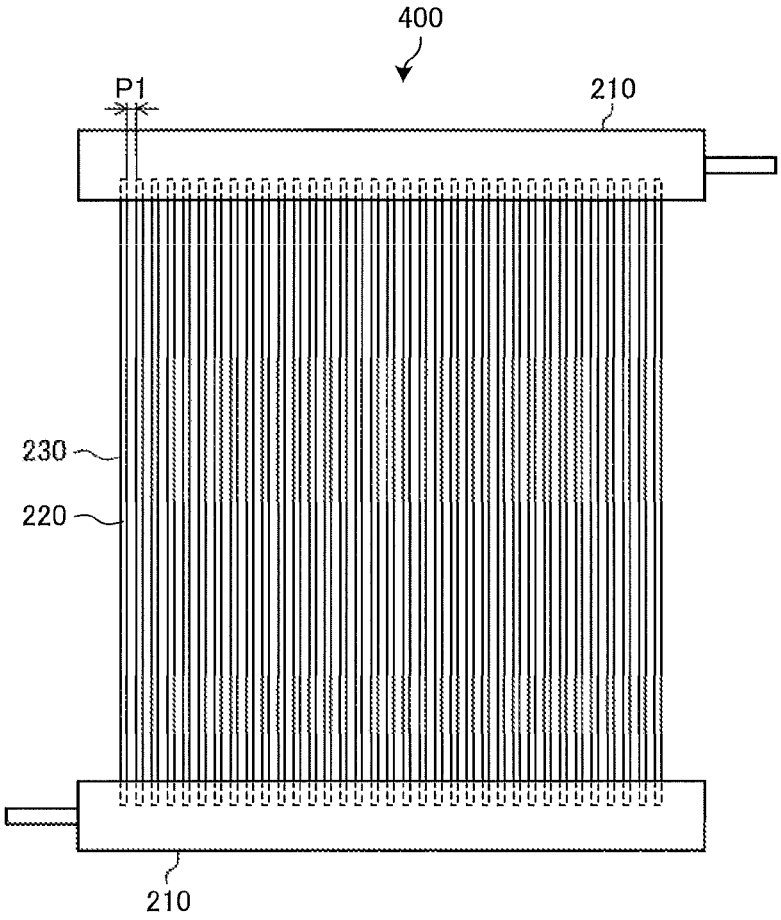
FIG. 3 is a diagram illustrating a finless heat exchanger according to Comparative Example.

Advantageous effects of the finless heat exchanger configured as described above will be described. To more clearly describe the advantageous effects of the finless heat exchanger according to Embodiment 1, a finless heat exchanger including heat transfer tubes including only straight portions will be described as Comparative Example, which is illustrated in FIG. 3. The finless heat exchanger according to Embodiment 1 will be described in comparison with the finless heat exchanger according to Comparative Example. FIG. 3 is a diagram illustrating the finless heat exchanger according to Comparative Example.

The finless heat exchanger, 400, according to Comparative Example has the same size and heat exchange performance as those of the finless heat exchanger according to Embodiment 1. Heat transfer tubes 220 each include only a straight portion. The straight portion 23 is connected at opposite ends to headers 210. The heat transfer tubes 220 in Comparative Example have the same major-axis and minor-axis dimensions as those of the heat transfer tubes 22 in Embodiment 1. Furthermore, the heat transfer tubes are arranged at a tube pitch P1, which is equal to a tube pitch P in FIG. 2. The tube pitch P is the interval between the adjacent straight portions 23.

The comparison between the finless heat exchanger 400 according to Comparative Example and the finless heat exchanger according to Embodiment 1 reveals that each heat transfer tube 22 of the finless heat exchanger according to Embodiment 1 can be formed by connecting the heat transfer tubes 220 in Comparative Example with the turning portions 24. In the finless heat exchanger according to Embodiment 1, therefore, a reduction in the number of heat transfer tubes 22 is achieved while the same heat exchange performance as that in Comparative Example is maintained. The larger the number of turning portions 24, the smaller the number of heat transfer tubes 22.

As described above, while the heat exchange performance is maintained, a reduction in the number of heat transfer tubes 22 is achieved in the finless heat exchanger according to Embodiment 1. This results in a reduction in the number of ends of the heat transfer tubes 22 fitted in the headers 21 and a reduction in the number of insertion holes 25 of the headers 21. Consequently, the insertion holes 25 can be arranged at relatively long intervals in the headers 21. This ensures that portions between the insertion holes of the headers have a width sufficient for reducing the likelihood of a processing failure, such as deformation upon processing. This leads to improved ease of processing of the headers. Thus, the headers 21 can be relatively easily produced at low cost.

A reduction in the number of heat transfer tubes 22 facilitates handling the heat transfer tubes 22 during assembly of the heat exchanger, significantly improving the ease of assembly.

Furthermore, a reduction in the number of ends of the heat transfer tubes 22 fitted in the headers 21 can provide distribution closer to ideal distribution by an amount corresponding to a reduction in the number of heat transfer tubes 22 when the refrigerant is distributed from the headers 21 to the individual heat transfer tubes 22. This leads to improved performance of refrigerant distribution to the individual heat transfer tubes 22 in the headers 21, thus enhancing the heat exchange performance. This can relatively easily provide a high-performance finless heat exchanger. In addition, the enhancement of the heat exchange performance allows a finless heat exchanger to be compact in size while the heat exchange performance is maintained.

A reduction in the number of heat transfer tubes 22 results in a reduction in the number of joints between the headers 21 and the heat transfer tubes 22, reducing the likelihood of poor joints. This improves the reliability of the finless heat exchanger.

Furthermore, since the finless heat exchanger does not include fins, the cost of material, the cost of processing, and the cost of die can be reduced, resulting in a significant reduction in cost of the heat exchanger.

As described above, according to Embodiment 1, each heat transfer tube 22 includes the straight portions 23 extending in the direction orthogonal to the arrangement direction and the turning portions 24 such that the straight portions 23 and the turning portion 24 are alternately and continuously arranged. In other words, the multiple straight portions 23 arranged side by side are connected by the turning portions 24, thus forming a single heat transfer tube. Such a configuration achieves a reduction in the number of heat transfer tubes of the entire finless heat exchanger while maintaining the heat exchange performance equivalent to that of the heat exchanger of FIG. 3. This results in a reduction in the number of insertion holes 25 of the headers 21, improving the ease of processing of the headers 21 and the ease of overall assembly. This leads to improved productivity. The improved productivity enables lower cost production.

Since the number of insertion holes 25 of the headers 21 can be reduced as described above, a low-cost, high-performance, high-quality, and compact finless heat exchanger can be provided.

Although Embodiment 1 has been described with respect to a case where the flat tube is used as an example of the heat transfer tube 22, the heat transfer tube 22 is not limited to the flat tube. The heat transfer tube 22 may be a cylindrical tube. If the heat transfer tubes 22 are cylindrical tubes, the same advantageous effects can be obtained. Note that the heat transfer tubes 22 are not limited to flat tubes. The same applies to the following embodiments unless otherwise stated. For the material for the heat transfer tubes 22, the aluminum-based material has been described as an example. If the heat transfer tubes 22 are made of copper-based material or iron-based material, the same advantageous effects can be obtained. The same applies to the following embodiments.

Specific dimensions of the finless heat exchanger including the flat tubes as the heat transfer tubes 22 will now be discussed.

Figure 4:
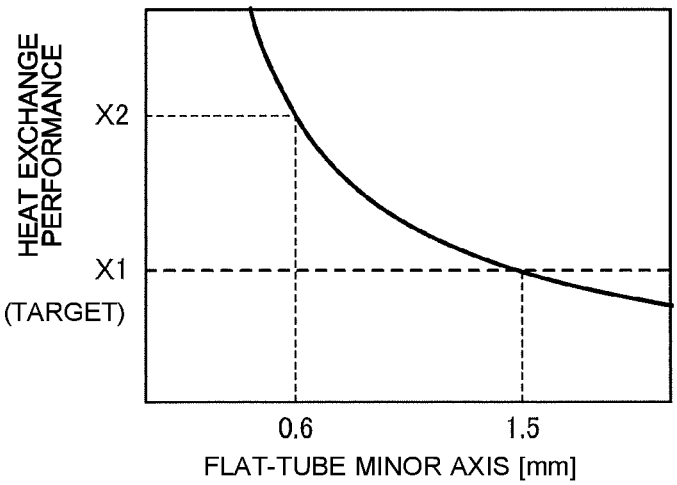
FIG. 4 is a graph illustrating an example of the relationship between the heat exchange performance of the finless heat exchanger and the minor-axis dimension of each heat transfer tube under conditions where air flow resistance is constant.
Figure 5:
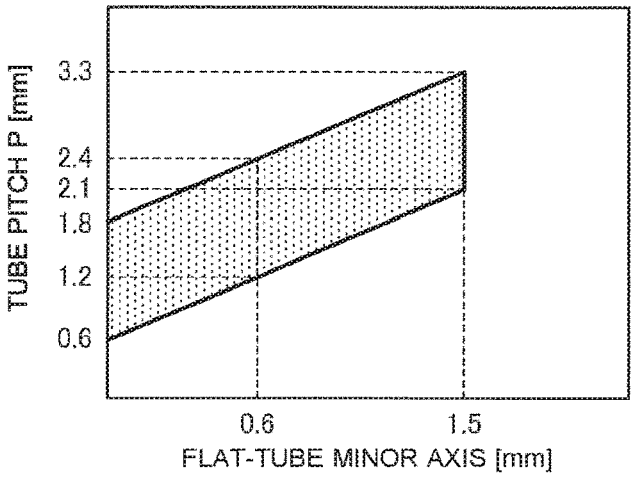
FIG. 5 is a graph illustrating the relationship between the minor-axis dimension of the heat transfer tube and the range of tube pitches P in which the same air flow resistance is obtained.

FIG. 4 is a graph illustrating an example of the relationship between the heat exchange performance of the finless heat exchanger and the minor-axis dimension of each heat transfer tube under conditions where air flow resistance is constant. FIG. 5 is a graph illustrating the relationship between the minor-axis dimension of the heat transfer tube and the range of tube pitches P in which the same air flow resistance is obtained. As described above, the tube pitch P is the interval between the adjacent straight portions 23. In FIG. 5, a hatched portion represents a range in which the same air flow resistance is obtained.

FIG. 4 demonstrates that the minor-axis dimension of the heat transfer tubes 22 has only to be reduced to provide higher heat exchange performance under conditions where the air flow resistance is constant. Furthermore, FIG. 5 demonstrates that, to obtain the same air flow resistance with different minor-axis dimensions, the smaller the minor-axis dimension of the heat transfer tube 22 is, the more the tube pitch has to be reduced. In other words, it is clear that the minor-axis dimension of the heat transfer tube 22 and the tube pitch have to be reduced to improve the heat exchange performance under conditions where the air flow resistance is constant.

FIGS. 4 and 5 demonstrate that the minor-axis dimension of the heat transfer tube 22 may be set to 1.5 mm and the tube pitch may be set in the range of 2.1 mm to 3.3 mm so that the finless heat exchanger exhibits heat exchange performance equivalent to target heat exchange performance X1. The term "target heat exchange performance X1" as used herein refers to heat exchange performance of a finned-tube heat exchanger including a plurality of fins. It is therefore clear that the minor-axis dimension of the heat transfer tube 22 may be set to 1.5 mm and the tube pitch may be set in the range of 2.1 mm to 3.3 mm so that the finless heat exchanger exhibits heat exchange performance equivalent to that of the finned-tube heat exchanger under conditions where the air flow resistance in the finless heat exchanger is the same as that in the finned-tube heat exchanger.

Furthermore, the minor-axis dimension of the heat transfer tube 22 may be further reduced to 0.6 mm and the tube pitch may be set in a lower range, or the range of 1.2 mm to 2.4 mm, so that the finless heat exchanger exhibits heat exchange performance X2 that is higher than the heat exchange performance X1.

As can be seen based on the area of the hatched portion in FIG. 5, the minor-axis dimension of the heat transfer tube 22 may be less than or equal to 1.5 mm and greater than 0 to allow the finless heat exchanger to exhibit heat exchange performance equivalent to the target heat exchange performance X1 under conditions where the air flow resistance is constant. In addition, a value obtained by subtracting the minor-axis dimension from the tube pitch may range from 0.6 [mm] to 1.8 [mm]. The lower limit "0.6" of this range is a value obtained by subtracting 1.5 from 2.1. The upper limit "1.8" is a value obtained by subtracting 1.5 from 3.3. Considering the performance of the air-conditioning apparatus, the air flow resistance does not necessarily have to be equal to that in the finned-tube heat exchanger. The finless heat exchanger has only to be designed so that the sum of the work of the compressor and the work of the indoor-unit fan or the outdoor-unit fan decreases.

As described above, when the minor-axis dimension of the heat transfer tube 22 is reduced under conditions where the air flow resistance is constant, the tube pitch has to be reduced. In other words, the number of heat transfer tubes 22 can be increased. Therefore, setting the minor-axis dimension of the heat transfer tube 22 to a small value prevents degradation of the ease of processing of the headers 21 and improves the heat exchange performance of the finless heat exchanger.

Embodiment 2

Embodiment 2 relates to a technique for eliminating the inconvenience of variations in the intervals between the straight portions 23 of the heat transfer tubes 22 during production. The following description will focus on components different from those in Embodiment 1. Components that are not described in Embodiment 2 are the same as those in Embodiment 1.

Figure 6:
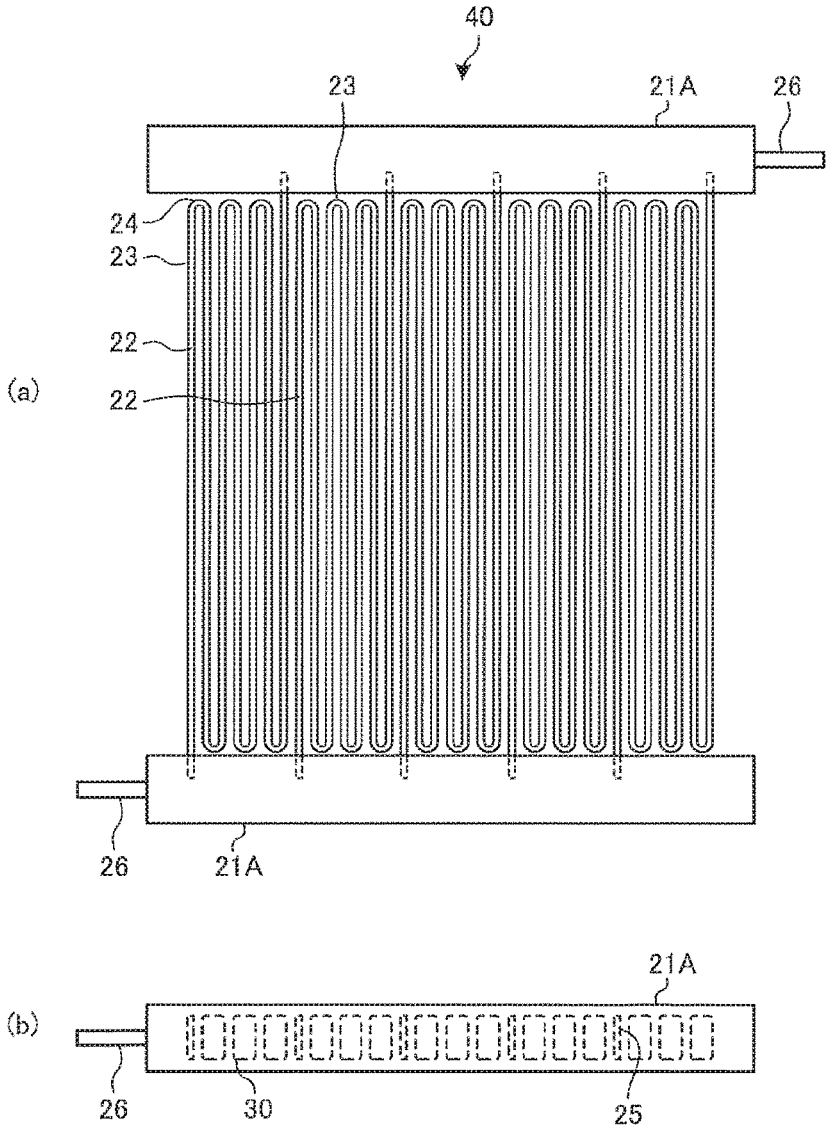
FIG. 6 includes diagrams schematically illustrating the structure of a finless heat exchanger according to Embodiment 2 of the present disclosure, (a) is a front view of the heat exchanger, and (b) is a bottom view thereof.
Figure 7:
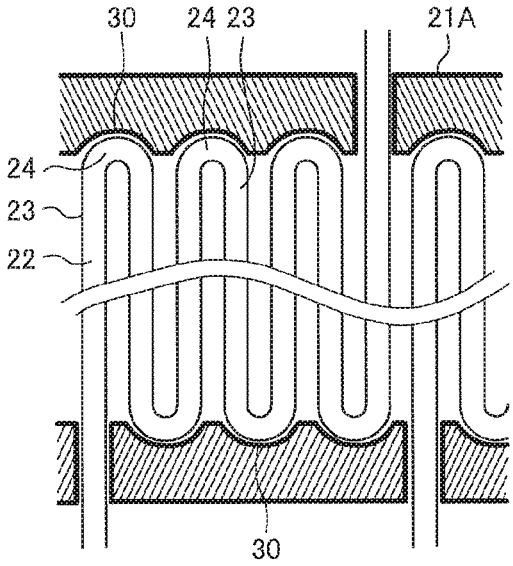
FIG. 7 is an enlarged view illustrating turning portions of heat transfer tubes in contact with headers in FIG. 6.

FIG. 6 includes diagrams schematically illustrating the structure of a finless heat exchanger according to Embodiment 2 of the present disclosure, (a) is a front view of the heat exchanger, and (b) is a bottom view thereof. FIG. 7 is an enlarged view of turning portions of heat transfer tubes in contact with headers in FIG. 6.

The finless heat exchanger according to Embodiment 2 differs from that according to Embodiment 1 in the configuration of each header 21. In Embodiment 2, each header 21A has recesses 30 located to face the turning portions 24 of the heat transfer tubes 22 and to support the turning portions 24. The recesses 30, each of which is shaped to fit the outer shape of the turning portion 24, are used as a positioning structure that supports the turning portions 24 to maintain the intervals between the straight portions 23 during production. Although FIG. 6 illustrates an example in which the recesses 30 are grooves arranged in components, serving as the headers 21A, the recesses 30 may be formed by curving the components, serving as the header 21A. Furthermore, although FIG. 6 illustrates the configuration in which the two headers each have the recesses 30, either one of the headers may have the recesses.

If the minor-axis dimension of each heat transfer tube 22 is reduced so that the heat transfer tubes 22 are closely arranged to improve the heat exchange performance, the rigidity of the heat transfer tube 22 will decrease. As a result, when both the ends of the heat transfer tubes 22 are joined to the headers 21A by brazing, residual thermal stress can be generated, deforming the heat transfer tubes 22. The deformation of the heat transfer tubes 22 can cause variations in the intervals between the adjacent turning portions 24.

For this reason, when both the ends of the heat transfer tubes 22 are fitted into the insertion holes 25 of the headers 21A, the turning portions 24 of the heat transfer tubes 22 are placed in the recesses 30, so that the turning portion 24 are positioned. In such a state, both the ends of the heat transfer tubes 22 are brazed to the headers 21A. This can prevent variations in the intervals between the adjacent turning portions 24 during production. Consequently, the turning portions 24 can be stably positioned, thus maintaining a uniform pitch between the adjacent straight portions 23. This reduces or eliminates a reduction in heat exchange performance caused by variations in the pitch of the straight portions 23.

As described above, since the header 21A have the recesses 30 to support the turning portions 24 of the heat transfer tubes 22, Embodiment 2 offers the following advantageous effects as well as the same advantageous effects as those of Embodiment 1. Specifically, the pitch between the adjacent straight portions 23 can be maintained uniform, reducing or eliminating a reduction in heat exchange performance caused by variations in the pitch.

The finless heat exchanger according to Embodiment 2 may be modified as follows. Such a modification also offers the same advantageous effects.

Figure 8:
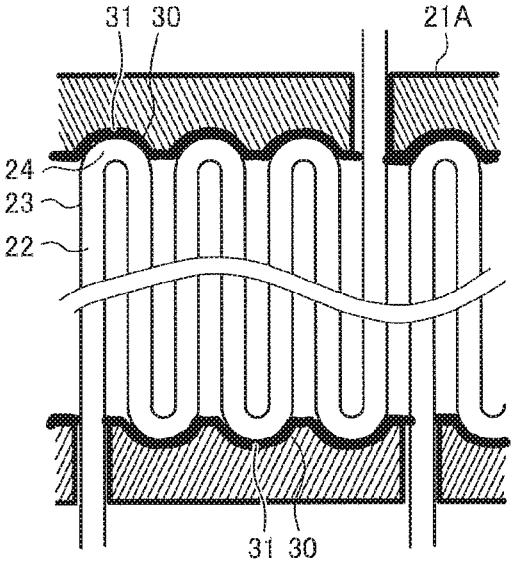
FIG. 8 is a diagram illustrating a modification of the finless heat exchanger according to Embodiment 2 of the present disclosure.

FIG. 8 is a diagram illustrating a modification of the finless heat exchanger according to Embodiment 2 of the present disclosure.

Although FIG. 7 described above illustrates the structure in which the turning portions 24 of the heat transfer tubes 22 are directly supported by the recesses 30 of the headers 21A, a structure in which, as illustrated in FIG. 8, heat insulating material 31 is interposed between the turning portions 24 of the heat transfer tubes 22 and the recesses 30 to support the turning portions 24 may be used. The heat insulating material 31 placed in the above-described manner can reduce or eliminate the transfer of heat from the turning portions 24 of the heat transfer tubes 22 to the headers 21A. This can prevent loss of heat exchange, leading to higher heat exchange performance than in a case without the heat insulating material 31.

Embodiment 3

The turning portions 24 of each heat transfer tube 22 are formed by bending the tubular material. It is easier to process the turning portions 24 as the bend radius of each turning portion 24 is larger. Embodiment 3 relates to the shape of the heat transfer tube based on the ease of processing of the turning portions 24. The following description will focus on components different from those in Embodiment 1. Components that are not described in Embodiment 3 are the same as those in Embodiment 1.

Figure 9:
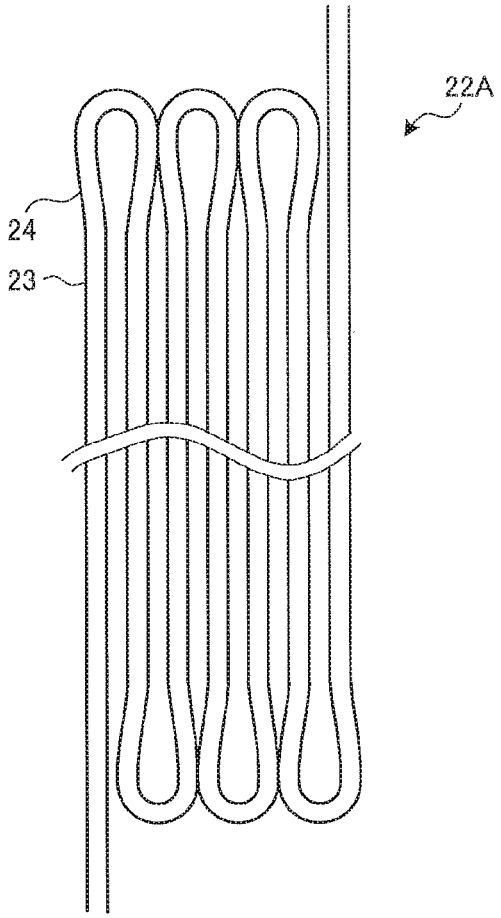
FIG. 9 is a diagram illustrating a heat transfer tube included in a finless heat exchanger according to Embodiment 3 of the present disclosure.
Figure 10:
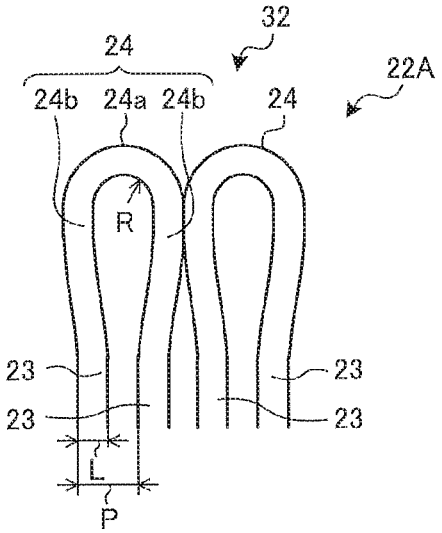
FIG. 10 is an enlarged view of turning portions of the heat transfer tube of FIG. 9.

A heat transfer tube 22A in Embodiment 3 will be described below in comparison with the heat transfer tube 22 in Embodiment 1. FIG. 9 is a diagram illustrating the heat transfer tube of a finless heat exchanger according to Embodiment 3 of the present disclosure. FIG. 10 is an enlarged view of turning portions of the heat transfer tube of FIG. 9. FIG. 11 is a diagram illustrating the heat transfer tube of the finless heat exchanger according to Embodiment 1 as a comparative example. FIG. 12 is an enlarged view of the turning portions of the heat transfer tube of FIG. 11.

As illustrated in FIG. 10, each turning portion 24 of the heat transfer tube 22A in Embodiment 3 includes a first part 24*a*, which is curved, and a pair of second parts 24*b* extending from both ends of the first part 24*a* toward each other. The straight portions 23 extend from ends of the second parts 24*b*.

Assuming that the tube pitch P, serving as the interval between the adjacent straight portions 23, in the heat transfer tube 22A in Embodiment 3 of FIG. 10 is the same as that in the heat transfer tube 22 in Embodiment 1 of FIG. 12, the bend radius of each turning portion 24 in Embodiment 3 will be compared with that in Embodiment 1. The bend radius, R, of the turning portion 24 in Embodiment 1 of FIG. 12 is a dimension of (tube pitch P−minor-axis dimension L)/2. In contrast, the bend radius R of the first part 24*a* of each turning portion 24 in Embodiment 3 of FIG. 10 can be increased up to a dimension close to (tube pitch P−minor-axis dimension L)/2×2 if the bend radius is permitted to increase so that the adjacent turning portions 24 come into contact with each other.

As described above, since each turning portion 24 of the heat transfer tube 22A is shaped to include the first part 24*a* that is curved and the pair of second parts 24*b* extending from both the ends of the first part 24*a* toward each other, Embodiment 3 offers the following advantageous effects as well as the same advantageous effects as those of Embodiment 1. Specifically, the bend radius R of the turning portion 24 can be increased without increasing the tube pitch P. This improves the ease of processing of the heat transfer tube 22A and thus improves the productivity of the finless heat exchanger. This provides a high-quality heat transfer tube with improved ease of processing of the turning portion 24.

To reduce or eliminate a reduction in heat exchange performance, the heat transfer tubes 22A are preferably not in contact with each other. If the heat transfer tubes 22A are in contact with each other such that only the first parts 24*a* of the turning portions 24 are in contact with each other, the heat exchange performance will not decrease markedly because the area of contact is small.

An increase in bend radius R of the turning portion 24 results in a reduction in residual strain caused by bending the heat transfer tube 22A, thus reducing or eliminating a reduction in strength of the heat transfer tube 22A. This can reduce or eliminate a reduction in factor of safety for internal pressure and a reduction in quality of the heat transfer tube 22A.

An increase in bend radius R of the turning portion 24 also results in a reduction in distance between the turning portions 24 of the adjacent heat transfer tubes 22A or contact of these turning portions. The heat transfer tubes 22 may be vibrated or deformed depending on operation conditions of the air-conditioning apparatus 1, so that the heat transfer tubes 22A may come into contact with each other and thus may be damaged or experience accumulation of fatigue. Unfortunately, the heat transfer tubes 22A may be broken. To prevent such breakage, portions of the adjacent heat transfer tubes 22A that are close to or in contact with each other are preferably joined together. This enhances the quality of the heat transfer tubes 22A and allows the heat transfer tubes 22A to be stably positioned, resulting in a uniform pitch of the heat transfer tubes 22A. This leads to improved heat exchange performance.

The heat transfer tube 22A, which has a configuration in FIGS. 9 and 10, of the finless heat exchanger according to Embodiment 3 may be modified as follows. Such a modification also offers the same advantageous effects.

Figure 13:
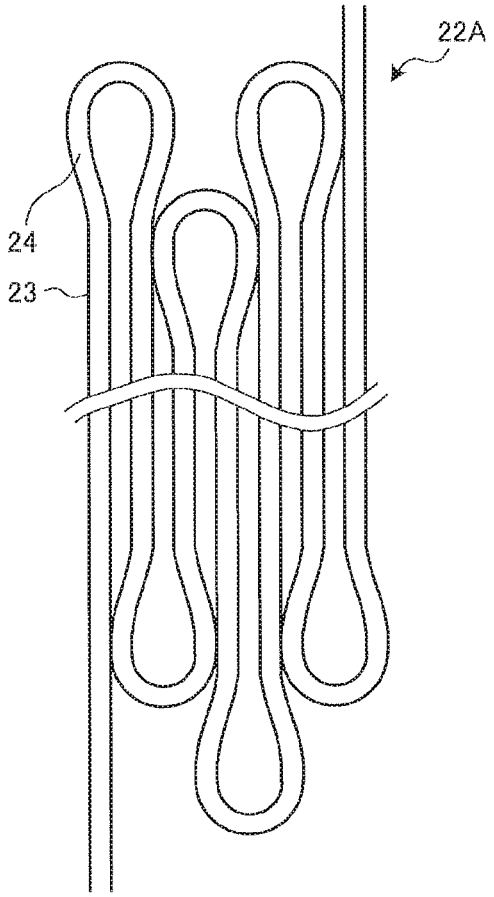
FIG. 13 is a diagram illustrating a modification of the heat transfer tube included in the finless heat exchanger according to Embodiment 3 of the present disclosure.
Figure 14:
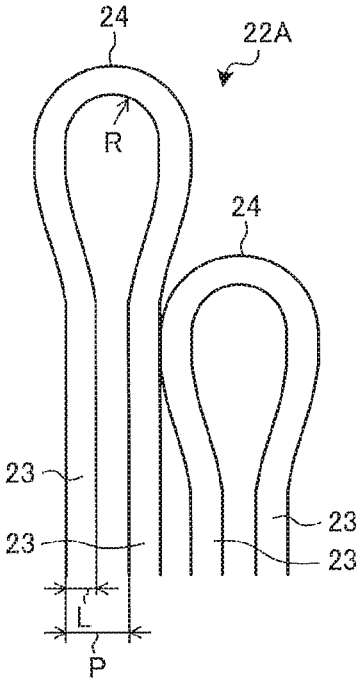
FIG. 14 is an enlarged view of turning portions of a heat transfer tube of FIG. 13.

FIG. 13 is a diagram illustrating a modification of the heat transfer tube of the finless heat exchanger according to Embodiment 3 of the present disclosure. FIG. 14 is an enlarged view of turning portions of the heat transfer tube of FIG. 13.

In this modification, the adjacent turning portions 24 are staggered in the arrangement direction of the heat transfer tubes 22A. Such a configuration allows the bend radius R of each turning portion 24 to increase up to approximately (tube pitch P−minor-axis dimension L)/2×3.

For the range of bend radii R of the turning portions 24 of the heat transfer tubes 22 and 22A illustrated in FIGS. 9 to 14, each bend radius R satisfies $r<R\leq 3r$, where r=(tube pitch P−minor-axis dimension L)/2. This range of bend radii applies to a case where the heat transfer tube is a flat tube. The present disclosure includes a configuration in which the bend radius R of at least one turning portion 24 of the heat transfer tube satisfies the above-described expression.

Embodiment 4

Embodiment 4 relates to miniaturization of the headers 21. The following description will focus on components different from those in Embodiment 1. Components that are not described in Embodiment 4 are the same as those in Embodiment 1.

Figure 15:
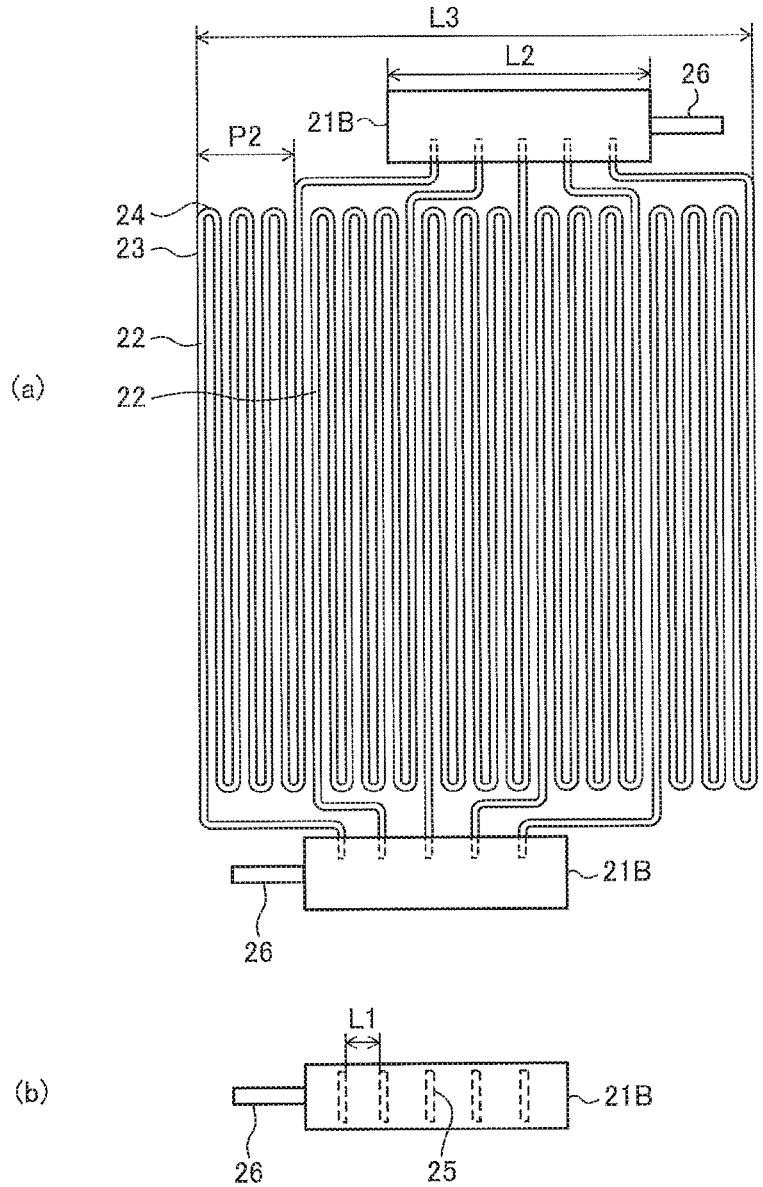
FIG. 15 includes diagrams schematically illustrating the structure of a finless heat exchanger according to Embodiment 4 of the present disclosure, (a) is a front view of the heat exchanger, and (b) is a bottom view thereof.

FIG. 15 includes diagrams schematically illustrating the structure of a finless heat exchanger according to Embodiment 4 of the present disclosure, (a) is a front view of the heat exchanger, and (b) is a bottom view thereof.

The finless heat exchanger according to Embodiment 4 includes headers 21B instead of the headers 21 in Embodiment 1. The headers 21B are headers miniaturized by making intervals L1 between the insertion holes 25 of the headers 21 to be smaller than arrangement intervals P2 between the adjacent heat transfer tubes 22 to such an extent as not to significantly reduce the ease of processing. Specifically, the length, L2, of each header 21B in the arrangement direction of the heat transfer tubes 22 is shorter than the overall length, L3, of an arrangement region where the multiple heat transfer tubes are arranged. The finless heat exchanger according to Embodiment 4 is configured such that the ends of the heat transfer tubes 22 are guided to the headers 21B, which are miniaturized in the above-described manner, via bends 32 as appropriate and are joined to the insertion holes 25.

Embodiment 4 offers the same advantageous effects as those in Embodiment 1. Furthermore, since the heat exchanger includes the miniaturized headers 21B, a reduction in internal volume of each header 21B is achieved. This results in a reduction in amount of refrigerant.

Although FIG. 15 illustrates the configuration in which each of the two headers 21 is miniaturized, at least one of the headers 21 may be miniaturized.

Embodiment 5

Embodiment 5 relates to the configuration of a finless heat exchanger including the miniaturized headers 21 described in Embodiment 4 and this configuration is intended to reduce the size of the entire finless heat exchanger. The following description will focus on components different from those in Embodiment 4. Components that are not described in Embodiment 5 are the same as those in Embodiment 4.

Figure 16:
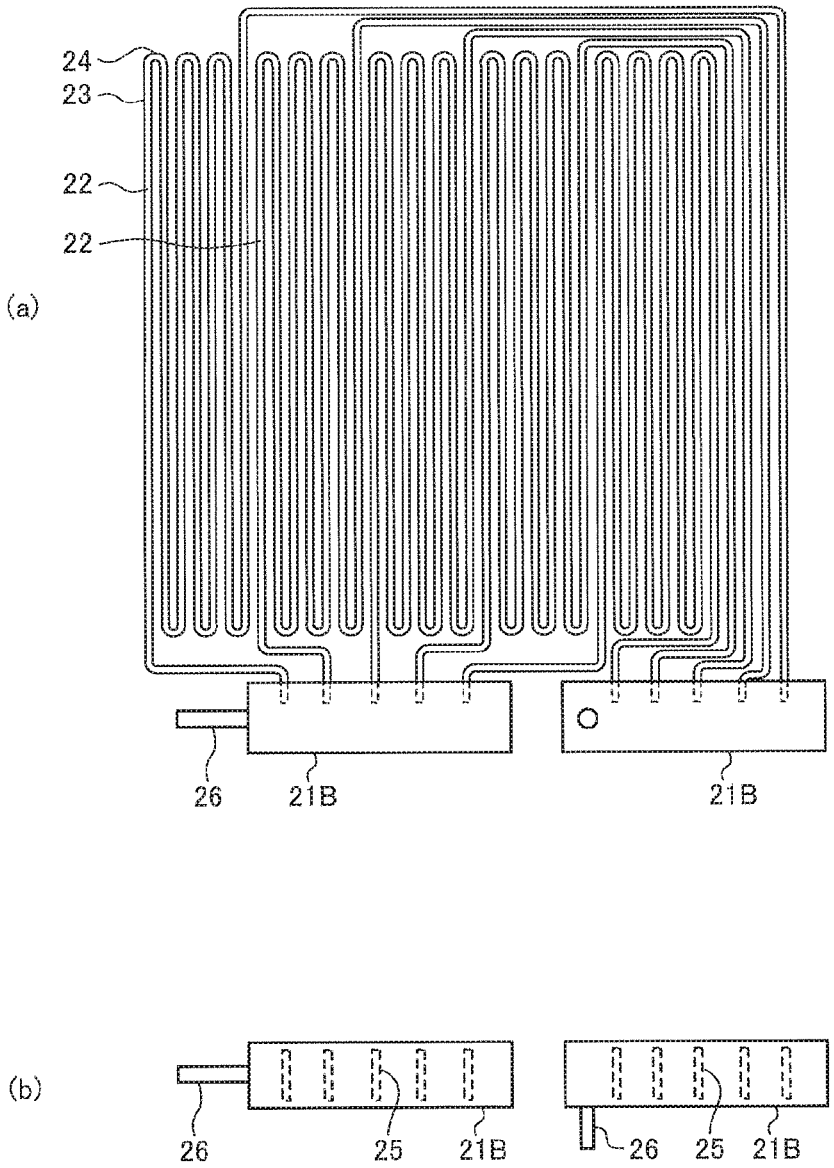
FIG. 16 includes diagrams schematically illustrating the structure of a finless heat exchanger according to Embodiment 5 of the present disclosure, (a) is a front view of the heat exchanger, and (b) is a bottom view thereof.

FIG. 16 includes diagrams schematically illustrating the structure of the finless heat exchanger according to Embodiment 5 of the present disclosure, (a) is a front view of the heat exchanger, and (b) is a bottom view thereof.

Although the two headers 21B are arranged on the opposite ends of the heat transfer tubes 22 in Embodiment 4, Embodiment 5 relates to a configuration in which the two headers 21B are arranged on one side where both ends of the heat transfer tubes 22 are arranged. Although the two headers 21B are arranged on a lower side where both the ends of the heat transfer tubes are arranged in the illustrated configuration, the headers may be arranged on an upper side where both the ends of the heat transfer tubes are arranged.

Since the two miniaturized headers 21B are arranged together on one side where both the ends of the heat transfer tubes 22 are arranged, Embodiment 5 offers the following advantageous effects as well as the same advantageous effects as those of Embodiment 4. Specifically, the arrangement region, in which the multiple heat transfer tubes 22 are arranged, in the housing is allowed to have a larger size than in the case where the two headers 21B are separately arranged on opposite sides where the opposite ends of the heat transfer tubes 22 are arranged. This results in an increase in area of a front surface of the finless heat exchanger. This leads to an increase in area of heat transfer, improving the heat exchange performance.

Embodiment 6

Embodiment 6 relates to a combined structure of the two headers 21B in Embodiment 5. The following description will focus on components different from those in Embodiment 5. Components that are not described in Embodiment 6 are the same as those in Embodiment 5.

Figure 17:
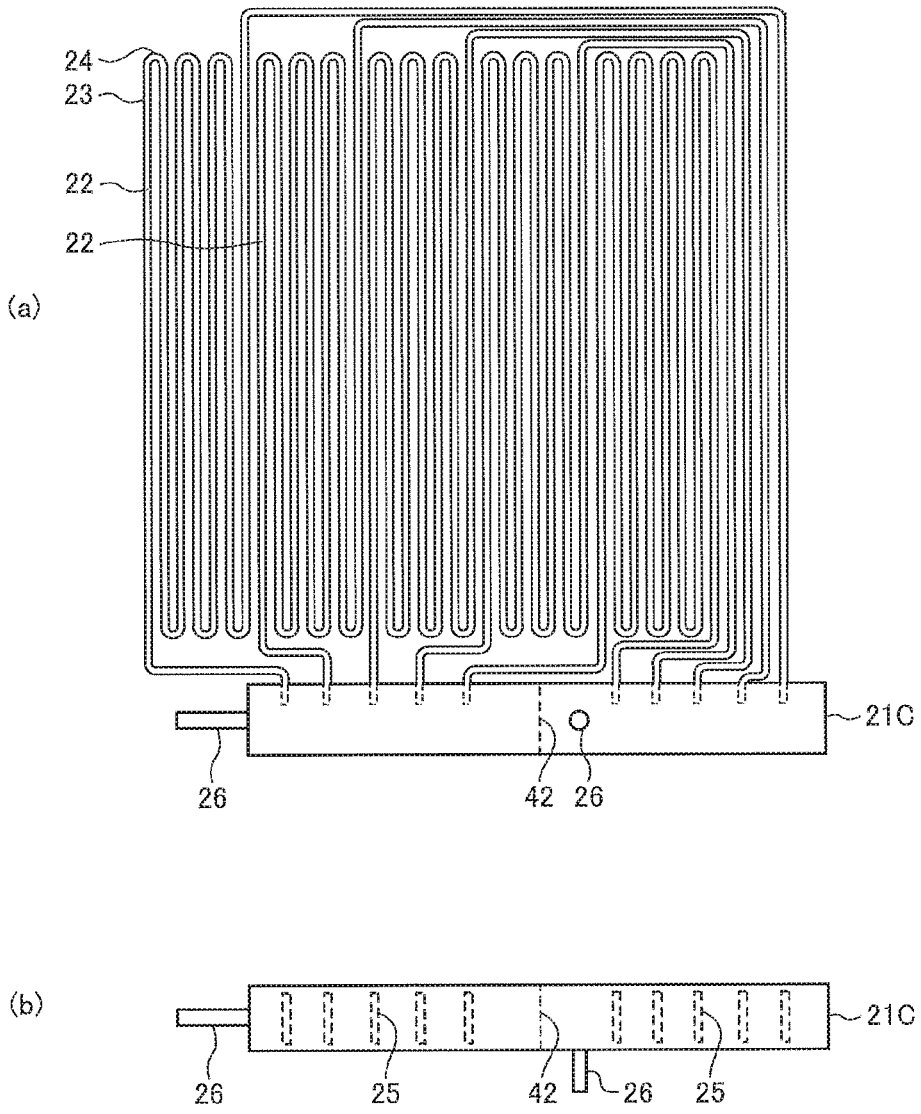
FIG. 17 includes diagrams schematically illustrating the structure of a finless heat exchanger according to Embodiment 6 of the present disclosure, (a) is a front view of the heat exchanger, and (b) is a bottom view thereof.

FIG. 17 includes diagrams schematically illustrating the structure of a finless heat exchanger according to Embodiment 6 of the present disclosure, (a) is a front view of the heat exchanger, and (b) is a bottom view thereof.

Instead of the two headers 21B arranged on one side where both the ends of the heat transfer tubes 22 are arranged in Embodiment 5, the finless heat exchanger according to Embodiment 6 includes a header 21C formed by combining the two headers 21B. In the header 21C, a space connected to first ends of the heat transfer tubes 22 is separated from a space connected to second ends of the heat transfer tubes 22 by a partition plate 42.

Embodiment 6 offers the same advantageous effects as those of Embodiment 5. Furthermore, since the header 21C has a configuration formed by combining two headers, the header 21C exhibits enhanced rigidity, leading to improved rigidity of the finless heat exchanger. Thus, the heat transfer tubes 22 are stably positioned and the tube pitch P of the straight portions 23 is kept at a predetermined pitch, leading to improved heat exchange performance.

Embodiment 7

Although each heat transfer tube 22 in Embodiment 1 described above is a single-piece component formed by bending the tubular material, each heat transfer tube 22 in Embodiment 7 is formed by joining multiple tubular materials. The following description will focus on components different from those in Embodiment 1. Components that are not described in Embodiment 7 are the same as those in Embodiment 1.

Figure 18:
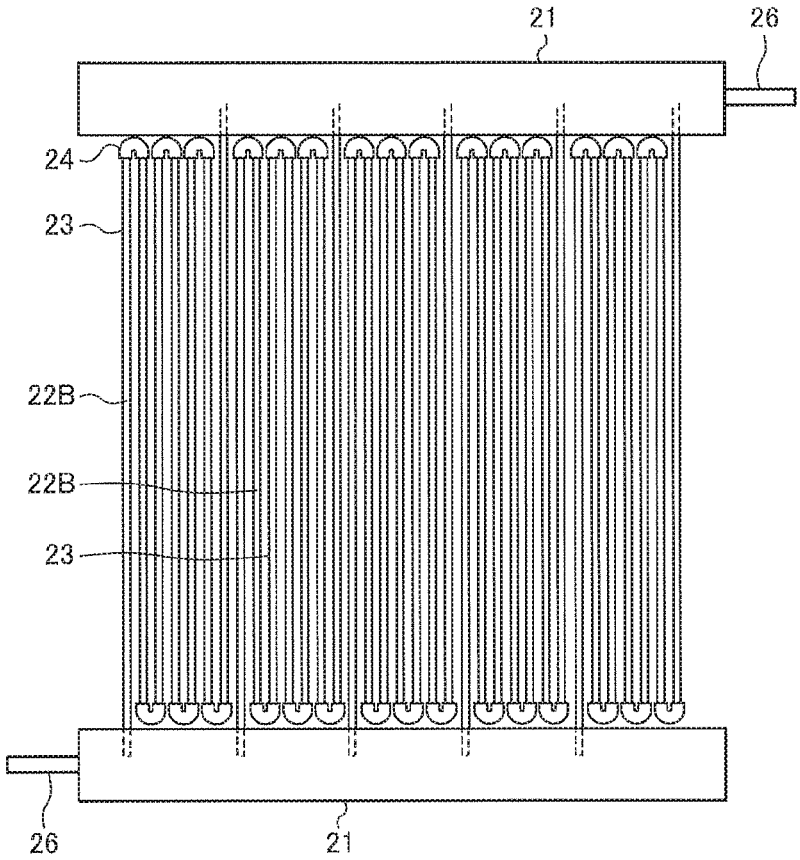
FIG. 18 is a schematic front view of the structure of a finless heat exchanger according to Embodiment 7 of the present disclosure.
Figure 19:
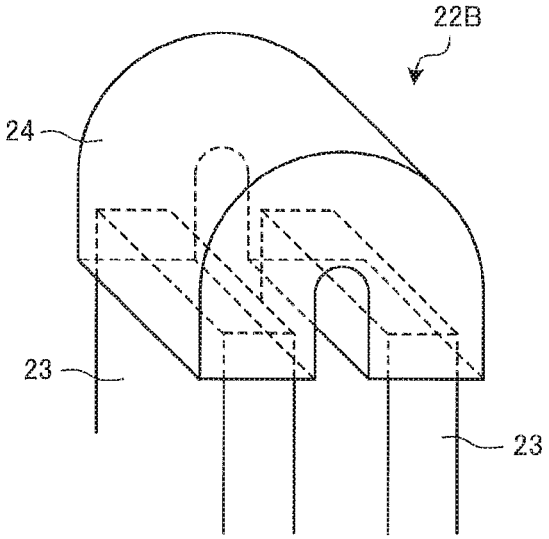
FIG. 19 is a perspective view of essential part of a heat transfer tube in FIG. 18.

FIG. 18 is a schematic front view of the structure of a finless heat exchanger according to Embodiment 7 of the present disclosure. FIG. 19 is a perspective view of essential part of the heat transfer tube in FIG. 18.

Each heat transfer tube 22B in Embodiment 7 includes straight and turning portions 23 and 24, which are formed as separate parts, joined by brazing, for example. Specifically, the turning portions 24 are configured as U-bent tubes.

Embodiment 7 offers the same advantageous effects as those of Embodiment 1.

Embodiment 8

Embodiment 8 differs from Embodiment 1 in the arrangement direction of the components of the finless heat exchanger. The following description will focus on components different from those in Embodiment 1. Components that are not described in Embodiment 8 are the same as those in Embodiment 1.

Figure 20:
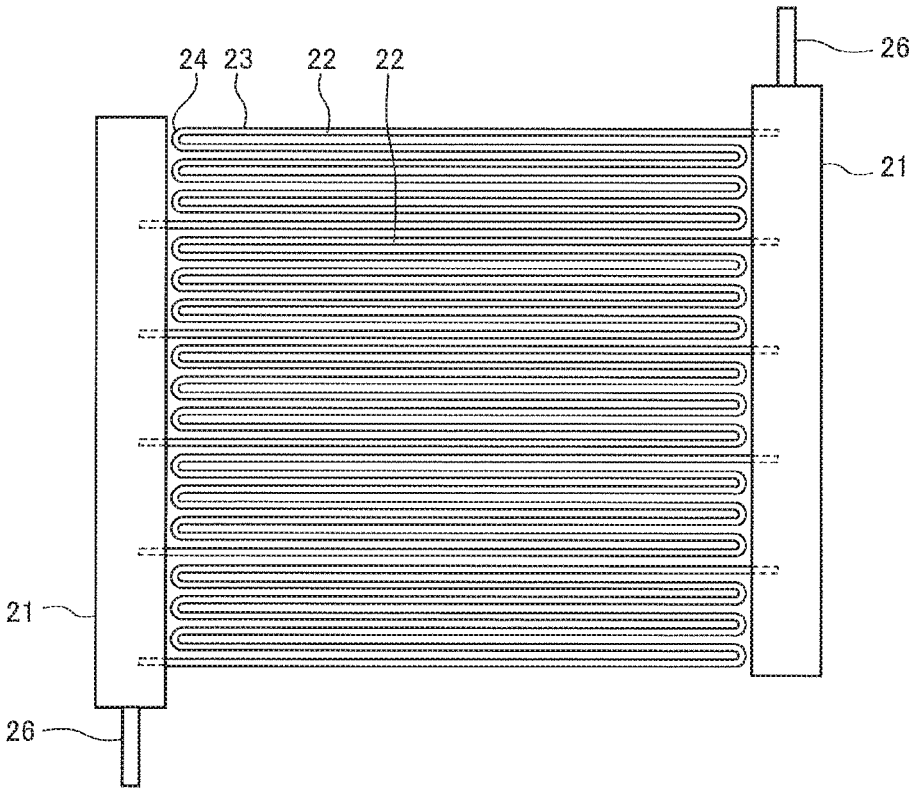
FIG. 20 is a schematic front view of the structure of a finless heat exchanger according to Embodiment 8 of the present disclosure.

FIG. 20 is a schematic front view of the structure of a finless heat exchanger according to Embodiment 8 of the present disclosure.

In the finless heat exchanger according to Embodiment 1 described above, the heat transfer tubes 22 are arranged side by side in a horizontal direction. As illustrated in FIG. 20, in the finless heat exchanger according to Embodiment 8, the heat transfer tubes 22 are arranged side by side in a vertical direction.

Embodiment 8 offers the same advantageous effects as those of Embodiment 1.

Embodiment 9

Although the finless heat exchanger according to Embodiment 1 described above has a flat overall form, a finless heat exchanger according to Embodiment 9 has an L-shaped overall form. The following description will focus on components different from those in Embodiment 1. Components that are not described in Embodiment 9 are the same as those in Embodiment 1.

Figure 21:
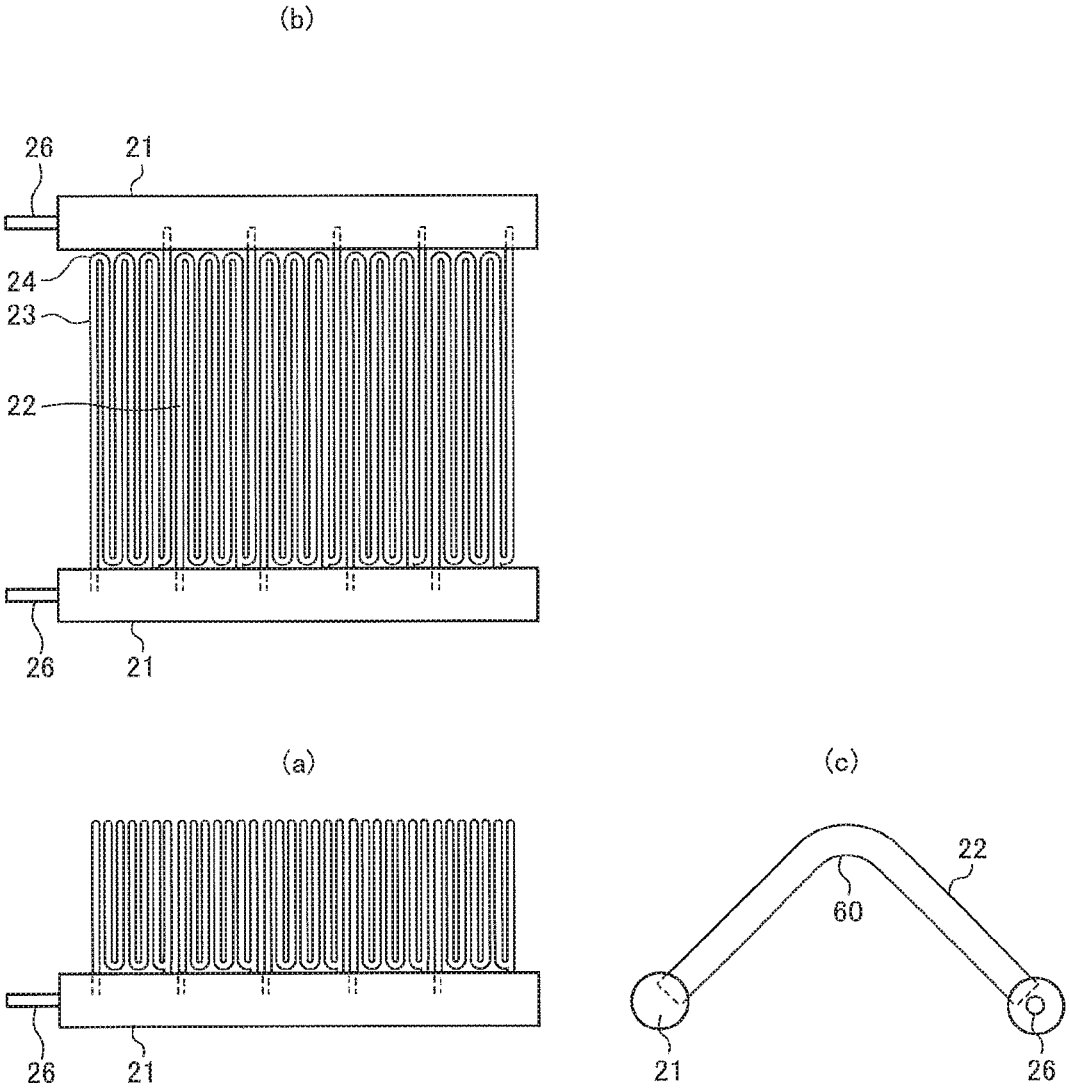
FIG. 21 includes schematic diagrams illustrating a finless heat exchanger according to Embodiment 9 of the present disclosure, (a) is a front view of the heat exchanger, (b) is a plan view thereof, and (c) is a side view thereof.

FIG. 21 includes schematic diagrams illustrating the finless heat exchanger according to Embodiment 9 of the present disclosure, (a) is a front view of the heat exchanger, (b) is a plan view thereof, and (c) is a side view thereof.

As illustrated in FIG. 21, the finless heat exchanger according to Embodiment 9 includes a plurality of heat transfer tubes 22 having bends 60 in middle portions thereof in the longitudinal direction of the heat transfer tubes 22. The finless heat exchanger has an L-shaped overall form. Specifically, the heat transfer tubes 22 have the bends at identical positions in the longitudinal direction. The finless heat exchanger according to Embodiment 9 is intended to be used as a heat exchanger for an indoor unit.

Embodiment 9 offers the same advantageous effects as those of Embodiment 1. Furthermore, since the finless heat exchanger according to Embodiment 9 has an L-shaped overall form, the heat exchanger can be effectively used, as an indoor-unit heat exchanger, in an indoor unit because it is difficult to allow the indoor unit to have a large front surface.

Embodiment 10

Embodiment 10 relates to a configuration in which the straight portions 23 of the heat transfer tubes 22 are arranged at a constant tube pitch P, or regular intervals, if the heat transfer tubes 22 are vibrated during operation of the air-conditioning apparatus 1. The following description will focus on components different from those in Embodiment 1. Components that are not described in Embodiment 10 are the same as those in Embodiment 1.

Figure 22:
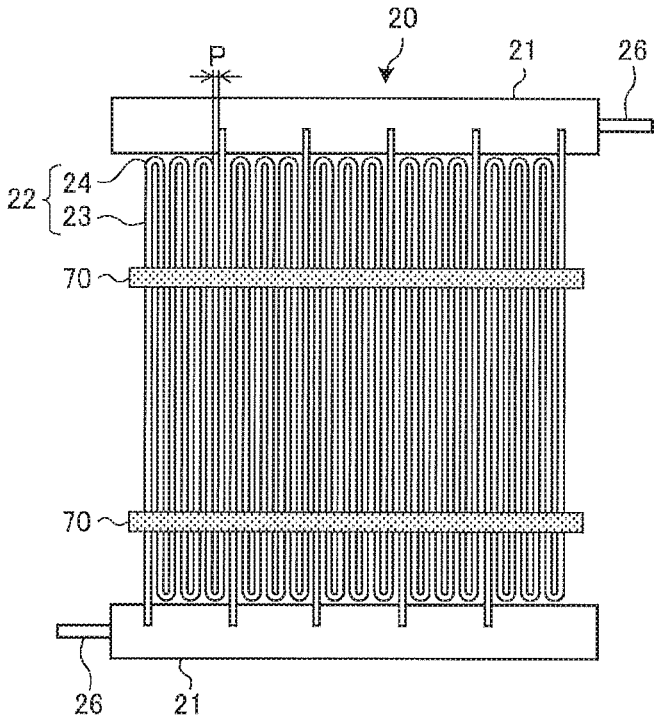
FIG. 22 is a schematic front view of a finless heat exchanger according to Embodiment 10 of the present disclosure.
Figure 23:
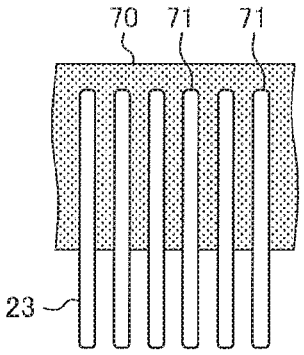
FIG. 23 is a partial sectional view of a positioning part in FIG. 22.

FIG. 22 is a schematic front view of the structure of a finless heat exchanger according to Embodiment 10 of the present disclosure. FIG. 23 is a sectional view illustrating part of a positioning part in FIG. 22.

The finless heat exchanger according to Embodiment 10 includes positioning parts 70, which are included in a positioning structure maintaining the tube pitch P of the straight portions 23 of the heat transfer tubes 22 constant. In such an example, two positioning parts 70 are arranged apart in the longitudinal direction of the heat transfer tubes 22. Each positioning part 70 is a rod-shaped component and has a plurality of indented insertion slots 71, to which the straight portions 23 of the heat transfer tubes 22 are fitted, arranged in the longitudinal direction of the positioning part 70. The insertion slots 71 are arranged at regular intervals corresponding to the intervals between the adjacent straight portions 23. The straight portions 23 are fitted in the insertion slots 71 of the positioning parts 70 so that the tube pitch P of the straight portions 23 can be maintained constant if the heat transfer tubes 22 are vibrated during operation of the air-conditioning apparatus 1. The positioning parts 70 are preferably made of resin having low thermal conductivity or heat insulating material.

Embodiment 10 offers the same advantageous effects as those of Embodiment 1. Furthermore, the heat transfer tubes 22 are positioned by the positioning parts 70, so that the tube pitch P is maintained constant. This leads to improved heat exchange performance.

A finless heat exchanger is reduced in diameter of heat transfer tubes to obtain heat exchange performance equivalent to that of a finned-tube heat exchanger, and such heat transfer tubes tend to have lower rigidity. However, since the positioning parts 70 are arranged, the straight portions 23 of the heat transfer tubes 22 are fitted in and supported by the insertion slots 71 of the positioning parts 70. This eliminates or reduces a reduction in rigidity of the heat transfer tubes 22, leading to improved rigidity of the heat exchanger.

The form of each positioning part 70, the number of positioning parts 70, and the positions of the positioning parts 70 do not necessarily have to be limited to those in FIGS. 22 and 23 and can be changed as appropriate without departing from the scope of operation of the positioning parts 70. For example, the number of positioning parts 70 is not limited to two, and may be one or three or more.

The present disclosure is not limited to Embodiments 1 to 10 described above, and can be variously modified within the scope of the present disclosure. Specifically, the configurations according to Embodiments described above may be appropriately modified and at least one element of the configurations may be substituted for another element. Furthermore, a component whose location is not particularly limited does not necessarily have to be disposed at the location described in Embodiments, and may be disposed at any location that enables the component to achieve its function.

Although Embodiments 1 to 10 have been described as different embodiments, the features of Embodiments 1 to 10 may be appropriately combined into a finless heat exchanger. For example, Embodiment 2 and Embodiment 4 may be combined, and the headers 21B in FIG. 15 may have the recesses 30 in Embodiment 2. For the modifications of the components in Embodiments 1 to 10, similar components in the embodiments other than the embodiment in which the modification has been described may be similarly modified.

Although the case where the finless heat exchanger according to the present disclosure is used as a heat source side heat exchanger has been described as an example, the finless heat exchanger according to the present disclosure may be used as a use side heat exchanger.

REFERENCE SIGNS LIST

1 air-conditioning apparatus 1A heat source side unit 1B use side unit 4 heat source side heat exchanger 21 header 21A header 21B header 21C header 22 heat transfer tube 22A heat transfer tube 22B heat transfer tube 23 straight portion 24 turning portion 24*a* first part 24*b* second part 25 insertion hole 26 refrigerant inlet-outlet 30 recess 31 heat insulating material 32 bend 40 heat source side heat exchanger 41 fan 42 partition plate 60 bend 70 positioning part 71 insertion slot 110 compressor 150 expansion device 160 flow switching device 170 accumulator 180 use side heat exchanger 210 header 220 heat transfer tube 400 finless heat exchanger

The invention claimed is:

1. A finless heat exchanger comprising:

two headers; and a plurality of heat transfer tubes spaced apart from each other and arranged side by side, the two headers each having a plurality of insertion holes, to which both ends of the plurality of heat transfer tubes are fitted and connected, the plurality of heat transfer tubes each including straight portions extending in a direction orthogonal to an arrangement direction in which the plurality of heat transfer tubes are arranged and turning portions, the straight portions and the turning portions being alternately arranged so that adjacent straight portions are connected by a turning portion, one or both of the two headers includes recesses that support the turning portions, and the straight portions and the turning portions of each of the plurality of heat transfer tubes extend along a same plane, and the insertion holes and the recesses are arranged along the same plane.

2. The finless heat exchanger of claim 1, further comprising:

a positioning structure maintaining intervals between the straight portions.

3. The finless heat exchanger of claim 2, wherein the positioning structure includes the recesses supporting the turning portions.

4. The finless heat exchanger of claim 2, wherein the positioning structure includes a positioning part having a plurality of indented insertion slots, to which the straight portions are fitted, arranged at intervals identical to the intervals between the straight portions that are adjacent.

5. The finless heat exchanger of claim 1, wherein each of the turning portions of the heat transfer tubes includes a first part that is curved and a pair of second parts extending from both ends of the first part toward each other.

6. The finless heat exchanger of claim 5, wherein the turning portions of the heat transfer tubes that are adjacent are joined together.

7. The finless heat exchanger of claim 1, wherein at least one of the two headers has the insertion holes arranged at intervals smaller than arrangement intervals between the heat transfer tubes that are adjacent and has a length in the arrangement direction in which the plurality of heat transfer tubes are arranged side by side, and the length is shorter than an overall length of an arrangement region, in which the plurality of heat transfer tubes are arranged, in the arrangement direction.

8. The finless heat exchanger of claim 7, wherein each of the two headers is disposed on one side where both the ends of the plurality of heat transfer tubes are arranged.

9. The finless heat exchanger of claim 8, wherein the two headers are combined to form a single-piece structure.

10. The finless heat exchanger of claim 1, wherein each of the plurality of heat transfer tubes includes the straight and turning portions that are configured as separate parts and are joined together.

11. The finless heat exchanger of claim 1, wherein the plurality of heat transfer tubes are arranged side by side in a horizontal direction.

12. The finless heat exchanger of claim 1, wherein the plurality of heat transfer tubes are arranged side by side in a vertical direction.

13. The finless heat exchanger of claim 1, wherein the plurality of heat transfer tubes have bends at identical positions in a longitudinal direction of the tubes.

14. The finless heat exchanger of claim 1, wherein each heat transfer tube is a flat tube having a flat cross-sectional shape with a major axis and a minor axis and including a plurality of through-holes, serving as passages.

15. The finless heat exchanger of claim 14, wherein each heat transfer tube has a minor-axis dimension that is a length of the minor axis, the minor-axis dimension is less than or equal to 1.5 [mm] and greater than 0, and a value obtained by subtracting the minor-axis dimension from a tube pitch, serving as an interval between the straight portions that are adjacent, ranges from 0.6 [mm] to 1.8 [mm].

16. The finless heat exchanger of claim 14, wherein in a case where each heat transfer tube has a minor-axis dimension that is a length of the minor axis, and the minor-axis dimension and a tube pitch, serving as an interval between the straight portions that are adjacent, are used to express r=(the tube pitch−the minor-axis dimension)/2, at least one of the turning portions of the heat transfer tube has a bend radius R [mm] that satisfies r [mm]<R≤3r [mm].

17. A refrigeration cycle apparatus comprising:

two headers; and a plurality of heat transfer tubes spaced apart from each other and arranged side by side, the two headers each having a plurality of insertion holes, to which both ends of the plurality of heat transfer tubes are fitted and connected, the plurality of heat transfer tubes each including straight portions extending in a direction orthogonal to an arrangement direction in which the plurality of heat transfer tubes are arranged and turning portions, the straight portions and the turning portions being alternately arranged so that adjacent straight portions are connected by a turning portion, one or both of the two headers includes recesses that support the turning portions, and the straight portions and the turning portions of each of the plurality of heat transfer tubes extend along a same plane, and the insertion holes and the recesses are arranged along the same plane; and a fan that supplies air to the finless heat exchanger.

18. A finless heat exchanger comprising:

a plurality of heat transfer tubes spaced apart from each other and arranged side by side; and two headers arranged apart from each other in a first direction orthogonal to an arrangement direction in which the heat transfer tubes are arranged side by side, the two headers extending in the arrangement direction, the two headers each having a plurality of insertion holes arranged in the arrangement direction, to which both ends of the plurality of heat transfer tubes are fitted and connected, the plurality of heal transfer tubes each including straight portions extending in the first direction orthogonal to the arrangement direction in which the plurality of heat transfer tubes are arranged and turning portions, the straight portions and the turning portions being alternately arranged so that adjacent straight portions are connected by the turning portions, two of the straight portions are connected spaced apart in the arrangement direction by the turning portions, the distance between the insertion holes adjacent to each other in the arrangement direction is greater than the distance in the arrangement direction between the two straight portions connected by the turning portions, one or both of the two headers has recesses that support the turning portions, the recesses are formed on a plane between the insertion holes adjacent to the arrangement direction, which is facing the turning portions.

* * * * *